US007097350B1

(12) United States Patent
Conus et al.

(10) Patent No.: US 7,097,350 B1
(45) Date of Patent: Aug. 29, 2006

(54) DETENT ESCAPEMENT FOR TIMEPIECE

(75) Inventors: Thierry Conus, Lengnau (CH); Andrés Cabezas Jurin, Yverdon-les-Bains (CH)

(73) Assignee: Montres Breguet SA, L'Abbaye (CH)

( * ) Notice: Subject to any disclaimer, the term of this patent is extended or adjusted under 35 U.S.C. 154(b) by 0 days.

(21) Appl. No.: 11/391,354

(22) Filed: Mar. 29, 2006

(30) Foreign Application Priority Data

Mar. 30, 2005 (EP) ..... 05006850

(51) Int. Cl.
*G04B 15/00* (2006.01)

(52) U.S. Cl. ..... 368/127; 368/131

(58) Field of Classification Search ..... 368/124, 368/127–133

See application file for complete search history.

(56) References Cited

U.S. PATENT DOCUMENTS 474,301 A * 5/1892 Pequegnat ..... 368/131
1,105,062 A * 7/1914 Cochran ..... 368/131
1,359,005 A * 11/1920 Verner ..... 368/132
2,362,836 A * 11/1944 McCullough ..... 368/130
3,462,942 A * 8/1969 Egger et al. ..... 368/132
3,538,705 A * 11/1970 Perry ..... 368/125
4,122,665 A * 10/1978 Giger ..... 368/327
6,301,981 B1 * 10/2001 Oechslin ..... 74/1.5

FOREIGN PATENT DOCUMENTS

| | | |
|---|---|---|
| CH | 641/75 | 1/1977 |
| EP | 1 538 490 A1 | 6/2005 |
| EP | 1 538 491 A1 | 6/2005 |
| EP | 1 544 689 A1 | 6/2005 |

OTHER PUBLICATIONS

European Search Report completed Jan. 13, 2006 in corresponding application No. EP 05 00 6850.

* cited by examiner

*Primary Examiner*—Vit W. Miska
(74) *Attorney, Agent, or Firm*—Griffin & Szipl, P.C.

(57) ABSTRACT

The invention concerns a detent escapement for a timepiece including an escape wheel fitted with teeth, a balance onto whose staff there is secured at least one roller 4 including an impulse pallet-stone and in the circular periphery of which a notch is made, and a blocking member in the form of a lever hinged on a pin, said blocking member carrying means for locking the escape wheel, a control finger-piece and a follower ending in a beak arranged for cooperating with the notch of said roller, characterized in that said roller further includes a safety finger-piece arranged for cooperating with the teeth of the escape wheel and locking the latter when the impulse pallet-stone is accidentally unlocked from the toothing of the escape wheel.

5 Claims, 5 Drawing Sheets

DETENT ESCAPEMENT FOR TIMEPIECE

This application claims priority from European Patent Application No. 05006850.1 filed Mar. 30, 2005, the entire disclosure of which is incorporated herein by reference.

FIELD OF THE INVENTION

The present invention relates to a detent escapement for a timepiece comprising an escape wheel provided with teeth, a balance onto the staff of which is secured at least one roller including an impulse pallet-stone and in the circular periphery of which a notch is made, and a blocking member in the form of a lever hinged on a pin, the blocking member carrying means for locking the escape wheel, a control finger-piece and a follower ending in a beak arranged for cooperating with the notch of said at least one roller.

BACKGROUND OF THE INVENTION

A detent escapement answering the above description has already been proposed in Swiss Patent Application No. CH 641/75. Timepieces comprising detent escapements are highly prized for their precision. Detent escapements have, however, an important defect in that they are very sensitive to shocks. Consequently, they are reputed to be unsuitable for wristwatches. Indeed, when the watch is subjected to a shock in which the impulse pallet-stone receives an impulse from the escape wheel, the shock can cause a reverse rotation of the roller and unlock the escape wheel from the impulse pallet-stone which unlocks said wheel, which can then rotate freely and damage the drive train and the escapement.

It is an object of the present invention to overcome the drawbacks of the aforementioned prior art by providing a detent escapement with improved shock resistance allowing it, in particular, to be easily integrated into a wristwatch.

SUMMARY OF THE INVENTION

The present invention therefore concerns a detent escapement for a timepiece comprising an escape wheel provided with teeth, a balance onto the staff of which is secured at least one roller comprising an impulse pallet-stone and in the circular periphery of which a notch is made, and a blocking member in the form of a lever hinged on a pin, the blocking member carrying means for locking the escape wheel, a control finger-piece and a follower ending in a beak arranged for cooperating with the notch of said roller, characterised in that said roller further includes a security finger-piece arranged for cooperating with the teeth of the escape wheel and for locking the latter when the impulse pallet-stone is accidentally unlocked from the toothing of the escape wheel.

Owing to these features, in the event of the impulse pallet-stone being unlocked from the escape wheel following a shock at the moment of impulse, the security finger-piece is inserted on the path of the escape wheel to block its travel. Any accidental unlocking of said wheel is thus prevented and hence any risk of damage to the drive and escapement mechanism of the watch.

According to an advantageous embodiment of the invention, the security finger-piece is placed at an angular distance a from the impulse pallet-stone lower than or equal to 40°, preferably comprised between 30 and 40° and even more preferably of the order of 35°. It will easily be understood that if the angular space between the impulse pallet-stone and the security finger-piece is too small or too large, the escape wheel tooth will not be intercepted.

BRIEF DESCRIPTION OF THE DRAWINGS

The invention will now be explained in detail hereinafter by an embodiment given by way of example, this embodiment being illustrated by the annexed drawings, in which.

DETAILED DESCRIPTION OF THE ILLUSTRATIVE EMBODIMENTS

Figure 1:
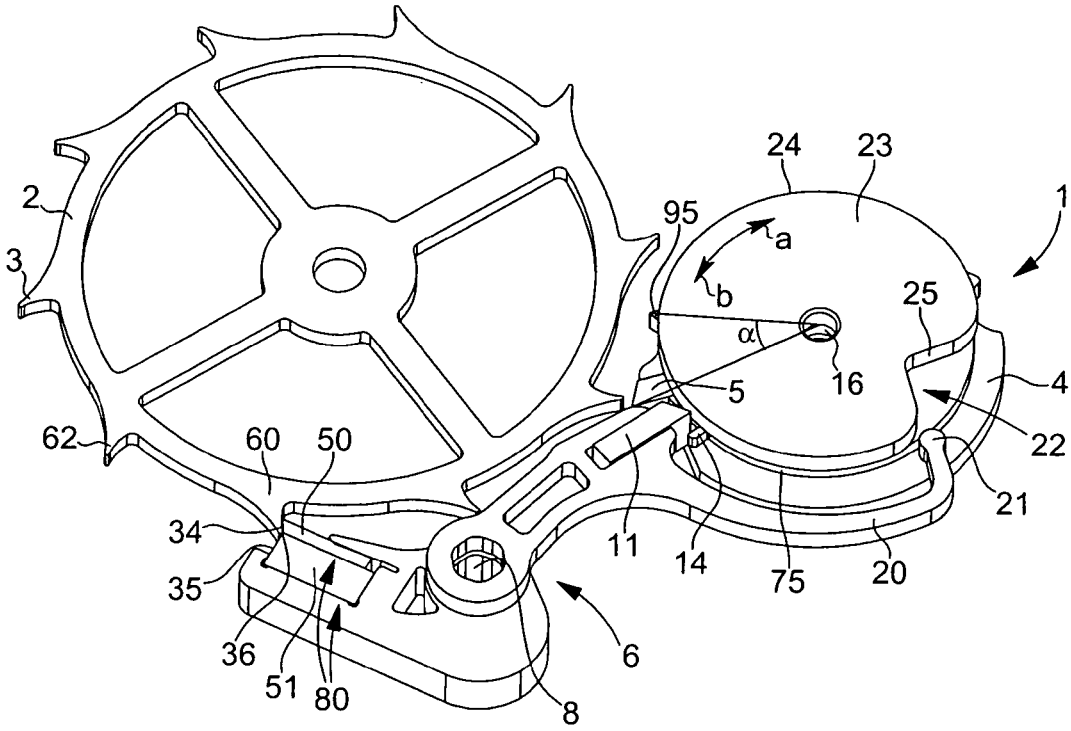
FIG. 1 is a perspective view of an embodiment of the escapement according to the invention.

The annexed Figures illustrate the detent escapement forming the subject of the present invention. The detent escapement includes an escape wheel 2 provided with teeth 3. Although this is not shown, wheel 2 is driven by the train of the timepiece which receives its drive force from a barrel. Rollers 1 are mounted on a balance staff 16 that is not shown in the Figures. These rollers 1 include a large roller 4 fitted with an impulse pallet-stone 5 and a small roller 23 provided with a circular periphery 24 in which a notch 22 is made having a rising edge 25. A first actuating finger-piece 14 surmounts large roller 4. The Figures show that this finger-piece 14 emerges from a disc 75 sandwiched between rollers 4 and 23. The escapement further includes a blocking member 6 in the form of a lever hinged on a pin 8. Blocking member 6 includes first and second parts fixedly connected by pin 8. The Figures show that the first part includes locking means 80 cooperating with the teeth 3 of escape wheel 2 and that the second part includes a second actuating finger-piece 11 arranged for cooperating with the first finger-piece 14, and a follower 20 ending in a beak 21 arranged for cooperating with rising edge 25 of notch 22 made in safety roller 23.

According to the main feature of the present invention, one of the rollers further includes a security finger-piece 95 arranged for cooperating with the teeth 3 of the escape wheel 2 and locking the latter when the impulse pallet-stone 5 is accidentally unlocked from the toothing of escape wheel 2. The radius connecting the centre 16 of rollers 1 to security finger-piece 95 and the radius connecting the same centre to the apex of impulse pallet-stone 5 form an angle $\alpha$ comprised between 30° and 40° to ensure proper interception of the teeth of the wheel if the rollers are accidentally turned over.

From the description that has just been given, it will be seen that all the components necessary to make a detent escapement are present. In this escapement, the wheel is unlocked when the rollers turn in one direction whereas it remains locked when the rollers turn in the other direction. Thus the impulse is only given to the balance once per oscillation during which the escape wheel rotates by one angular step whereas, in the lever escapement, the same wheel progresses by a half-step at each vibration. This constitutes one of the advantages of the detent escapement since the energy wasted by the inertia of the escape wheel only occurs once per oscillation instead of once per vibration.

The first and second actuating finger-pieces 14 and 11 are rigidly secured respectively onto the large roller 4 and the blocking member 6 and are arranged for cooperating with each other such that when rollers 1 rotate in a first direction, the first finger-piece 14 drives the second finger-piece 11 to unlock the locking means 80 from escape wheel 2, beak 21 of follower 20 being then driven by the rising edge 25 of notch 22 to re-engage the locking means in the escape wheel, and such that when rollers 1 rotate in a second direction, opposite to the first, the first finger-piece 14 drives the second 11 to keep locking means 80 engaged in escape wheel 2.

In the embodiment illustrated in the Figures, locking means 80 have first and second pallet-stones 50 and 51, arranged one beside the other. These pallet-stones have respectively first and second locking planes 34 and 35. These locking planes are inclined in relation to each other to form a locking line 36. As will be seen hereinafter, following the detailed analysis of the operating phases of the escapement, the first plane 34 intercepts a tooth 62 of wheel 2 when follower 20 is being driven by rising edge 25 of the notch 22, rollers 1 rotating in a first direction. After this, tooth 62 comes to rest on locking line 35. The second plane 35 is then scaled by the same tooth 62 when the first finger-piece 14 is driving second finger-piece 11, rollers 1 rotating in a second direction. Finally, tooth 62 returns to locking line 35 when the second finger-piece leaves the first.

One complete oscillation of the balance is illustrated in FIGS. 2 to 13. The different phases of operation will now be analysed.

Figure 2:
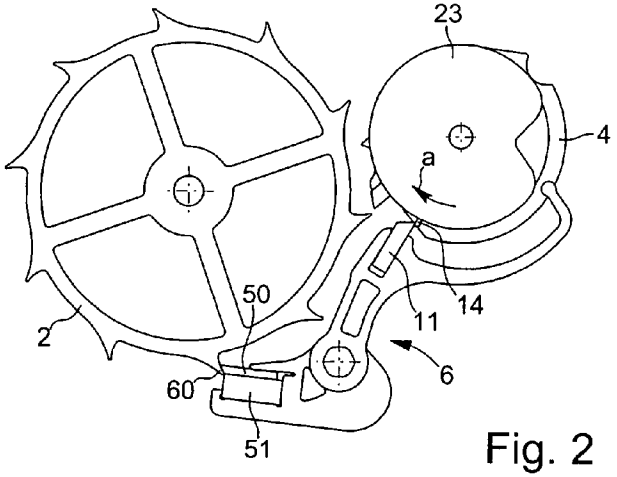

In FIG. 2, rollers 4 and 23 are rotating in the direction of arrow a. The first finger-piece 14 surmounting large roller 4 enters into contact with the second finger-piece 11 of blocking member 6. Locking pallet-stones 50 and 51 are fully engaged in tooth 60 of wheel 2 which is locked. Since this is the beginning of contact between the roller and blocking member, this is the beginning of the unlocking.

Figure 3:
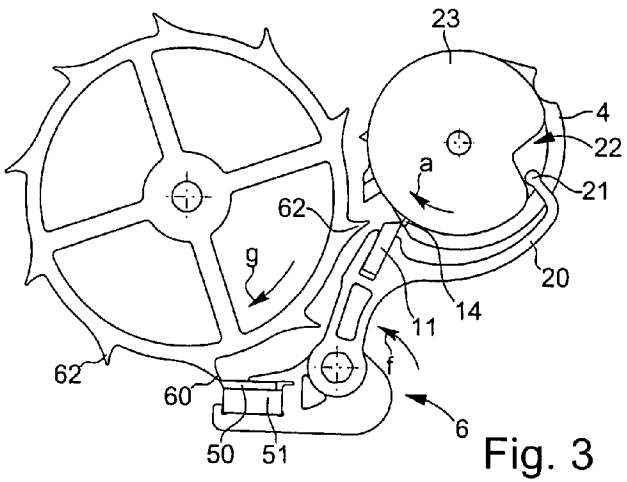
FIGS. 2 to 13 are plan views explaining the operating phases of the escapement illustrated in FIG. 1, these phases covering the first and second vibrations of an oscillation of the balance in normal operation.

The end of unlocking is shown in FIG. 3. As rollers 4 and 23 are still rotating in the direction of arrow a, finger-piece 14 is driving finger-piece 11 while tipping blocking member 6 in the direction of arrow f which unlocks locking pallet-stones 50 and 51 from tooth 60 while imparting a slight backward movement on wheel 2 in the direction of arrow g. Beak 21 of follower 20 starts to penetrate notch 22 of small roller 23.

Figure 4:
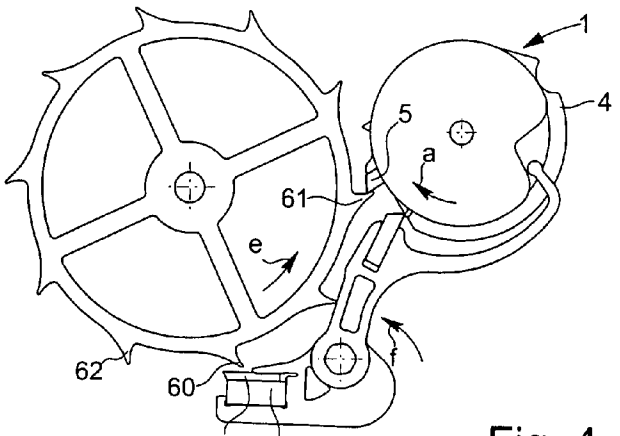

The start of the impulse is shown in FIG. 4. Wheel 2, released from locking pallet-stones 50 and 51, begins to rotate in the direction of arrow e, moved by the drive force that the barrel confers on the gear train. Tooth 61 of wheel 2 encounters impulse pallet-stone 5 fitted to large roller 4 and sends rollers 1 back in the direction of arrow a.

Figure 5:
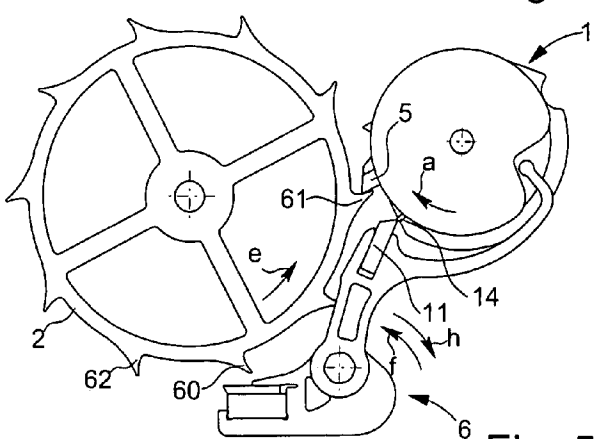

FIG. 5 shows the impulse in progress. Roller 1 and wheel 2 continue to rotate in the direction of arrows a and e respectively. Upon reaching the end of the contact between the roller and blocking member, finger-piece 14 prepares to pass over the tip of tooth 11. Blocking member 6 which was tipping in the direction of arrow f, prepares to tip in the other direction (arrow h).

Figure 6:
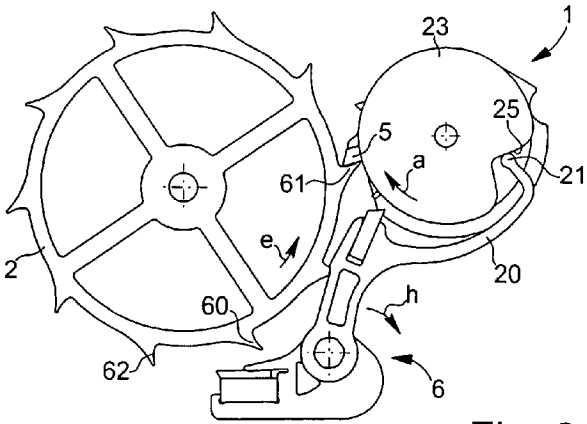

In FIG. 6, wheel 2 continues to rotate in the direction of arrow e and continues to drive rollers 1 via the action of tooth 61 on impulse pallet-stone 5 until the moment when beak 21 of follower 20 enters into contact with rising edge 25 of small roller 23. Henceforth, blocking member 6 is driven in the direction of arrow h.

Figure 7:
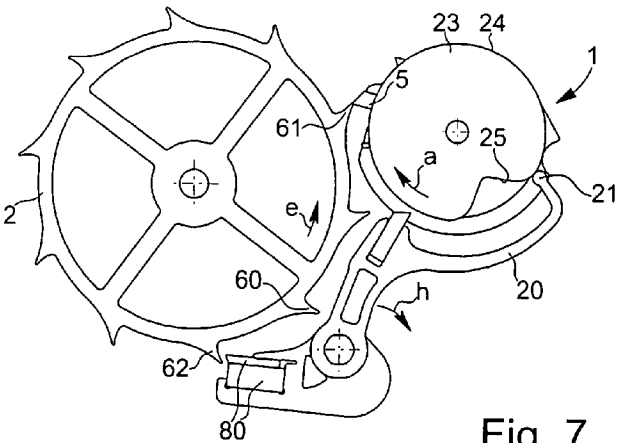

FIG. 7 illustrates the end of the impulse of tooth 61 on pallet-stone 5. In this situation and following the rotation of rollers 1 in the direction of arrow a, beak 21 has passed over rising edge 25 of notch 22 made in small roller 23 and is then abutting on the circular periphery 24 of the safety roller. Blocking member 6 has been continually driven in the direction of arrow h and reaches the end of its return travel. It can be seen that tooth 62, driven in the direction of arrow e, is preparing to be intercepted by locking means 80.

Figure 8:
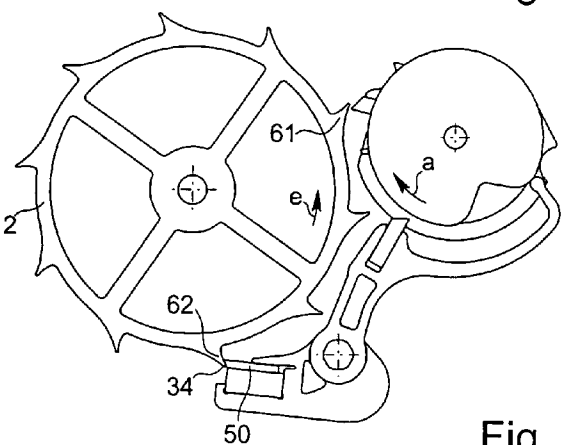

FIG. 8 shows the locking position. Tooth 62 abuts against the first locking plane 34 of the first locking pallet-stone 50.

Figure 9:
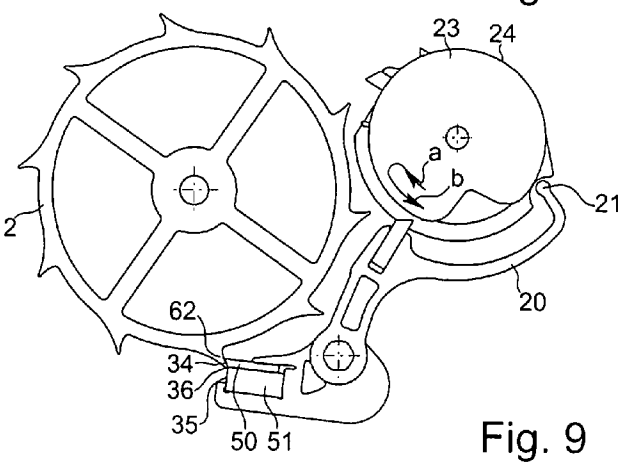

FIG. 9 shows the total locking of tooth 62 against the locking means formed here of first and second locking pallet-stones 50 and 51. The tip of the tooth 62, thrust by the kinetic energy of wheel 2, is housed on the locking line 36 formed by the inclination of the first and second locking planes 34 and 35 respectively belonging to the first and second locking pallet-stones 50 and 51. This is the draw effect, well known to watchmakers. Tooth 62 is thus housed on the locking line 36, while the second locking face 35 stands before the tooth and prevents it from continuing on its path. FIG. 9 also shows that beak 21 of follower 20 has been released from circular periphery 24 of small roller 23, leaving the balance entirely free to continue its supplementary arc and to end its first vibration along the direction shown by arrow a. It will also be noted that from this moment onwards the escapement is resistant to any shocks that might affect the timepiece. Indeed, a shock could cause beak 21 to abut against periphery 24 of small roller 23, without causing pallet-stones 50 and 51 to be unlocked, since the tooth 62 is immediately returned to locking line 36 owing to the aforementioned draw. Once the first vibration has finished, the balance reverses its direction and rotates in the direction of arrow b.

Figure 10:
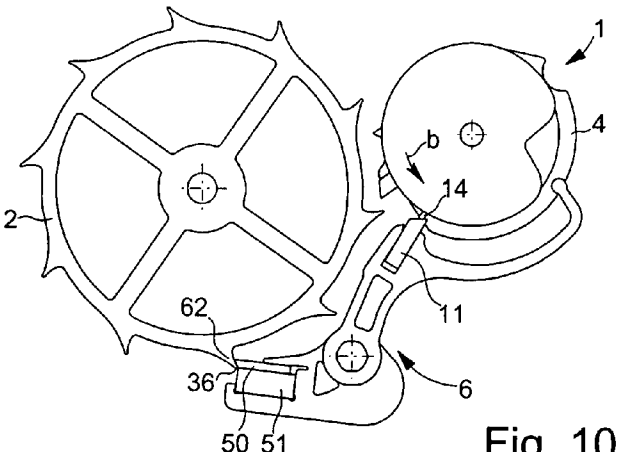

FIG. 10 shows the escapement at the end of the reverse supplementary arc, i.e. towards the end of the second vibration. Rollers 1 are rotating in the direction of arrow b. The Figure shows the situation at the moment when second finger-piece 14, which is surmounting table roller 4, enters into contact with first finger-piece 11 mounted on blocking member 6. The latter is still immobile and tooth 62 of wheel 2 is still housed on locking line 36 of pallet-stones 50 and 51.

Figure 11:
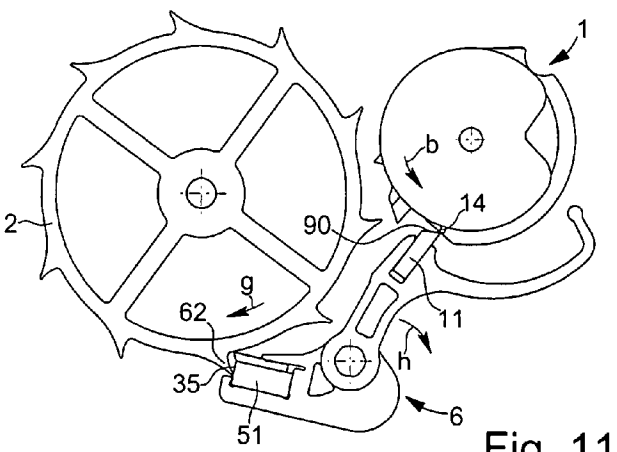

In FIG. 11, rollers 1 have continued their travel in the direction of arrow b and second finger-piece 14 has slid over a bevel 90 made at the end of first finger-piece 11 which causes the rotation of blocking member 6 in the direction of arrow h. Consequently tooth 62 of wheel 2 scales the second locking face 35 of the second locking pallet-stone 51, which drives wheel 2 in a slight backward movement noted here by the arrow g.

Figure 12:
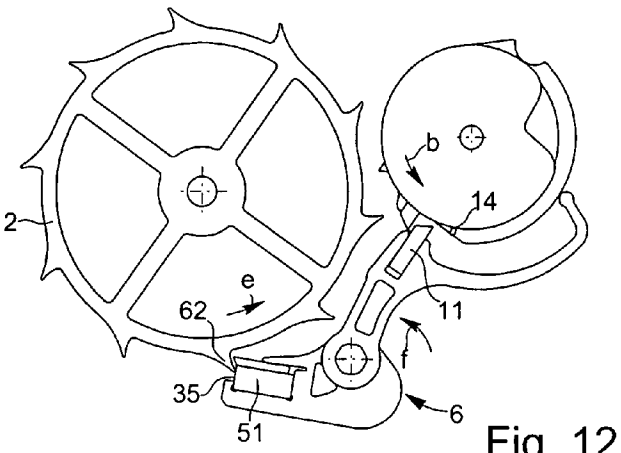
Figure 17:
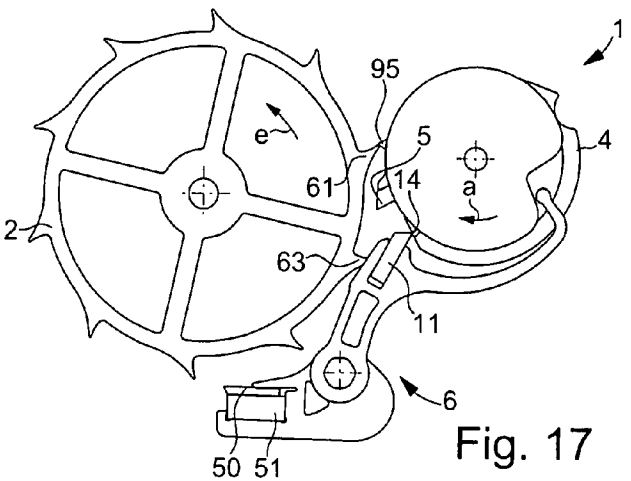

In FIG. 12 the first and second finger-pieces 11 and 14 are separated, with rollers 1 still rotating in the direction of arrow b. Henceforth, the tip of tooth 62, thrust by the kinetic energy of wheel 2, which is rotating in the direction of arrow e, descends the second locking plane 35 of pallet-stone 51 again to become housed on locking line 36 as is shown in FIG. 17. This is the same draw effect as mentioned with reference to FIG. 9, but acting on face 35 of pallet-stone 51. This effect could be called "counter-draw".

Figure 13:
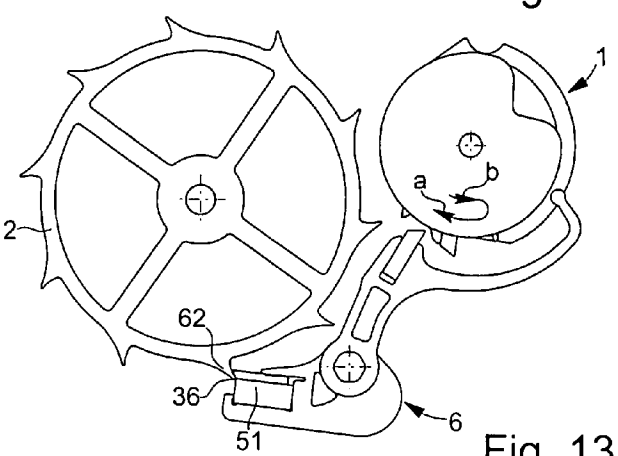

From the situation shown in FIG. 13, the balance and therewith rollers 1 end their supplementary arc in the direction of arrow b then change direction (arrow a) to restart a new oscillation, the second vibration having finished.

FIGS. 14 to 17 are plan views explaining the operating phases of the escapement illustrated in FIG. 1 in the event that a shock is applied to the timepiece.

Figure 14:
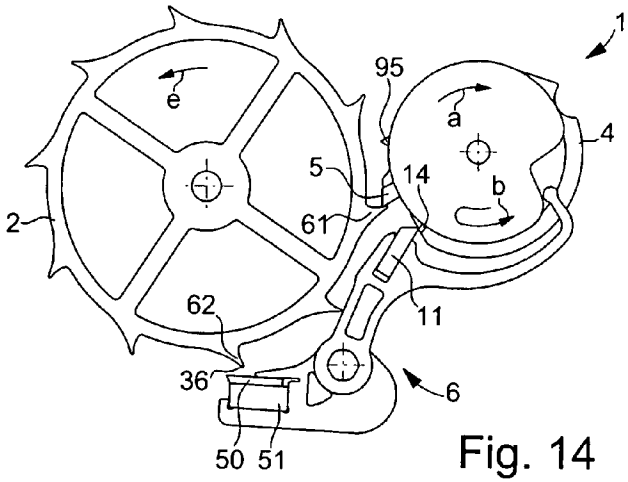

FIG. 14 is identical to FIG. 4 and illustrates the start of the impulse. Wheel 2, released from pallet-stones 50 and 51 start to rotate in the direction of arrow e, moved by the drive force that the barrel confers on the gear train. Tooth 61 of wheel 2 encounters impulse pallet-stone 5 fitted to large roller 4 and sends rollers 1 back in the direction of arrow a.

It is assumed that at this precise moment a shock is applied to the timepiece, which has the effect of reversing the direction of rotation of rollers 1 to make them rotate in the opposite direction b. This leads to the situation illustrated in FIG. 15 where the tip of impulse pallet-stone 5 passes over the top of the tip of tooth 61 forcing wheel backwards for a brief moment in the direction of arrow g.

Figure 15:
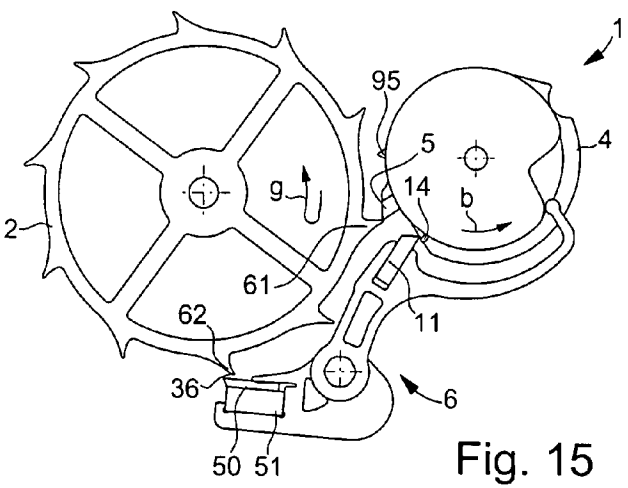
FIGS. 14 to 17 are plan views explaining the operating phases of the escapement illustrated in FIG. 1 in the event of a shock applied to the timepiece.
Figure 16:
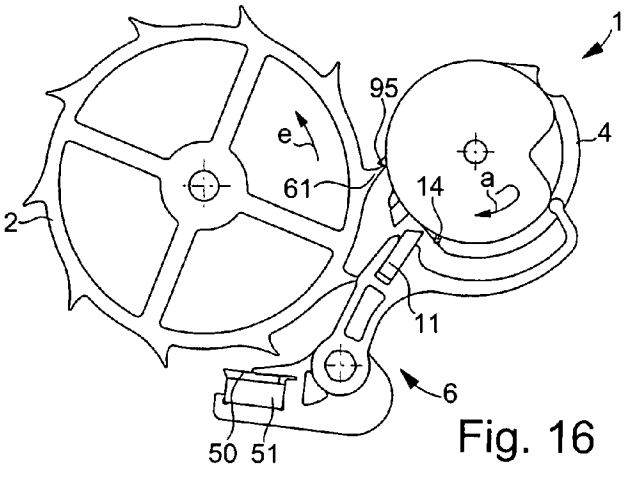

FIG. 16 shows that from the situation shown in FIG. 15, there is no longer anything to keep wheel 2 rotating in the direction in which it is normally driven by the gear train (arrow e) and FIG. 16 shows clearly that if safety finger-piece 95 was not present, wheel 2 would continue to rotate freely causing serious damage to the escapement and drive mechanism. On the contrary, the tip of tooth 61 strikes safety finger-piece 95 which reverses the direction of rotation of rollers 1 and consequently re-establishes the proper direction illustrated by arrow a.

FIG. 17 shows the situation where tooth 61 leaves safety finger-piece 95, which allows tooth 63 to give a new impulse to pallet-stone 5.

It will be noted that safety finger-piece 95 is located at the same level as impulse pallet-stone 5, which could be that of large roller 4. Safety finger-piece 95 can be made in one piece with roller 4 or added to the latter in the form of a set jewel like impulse pallet-stone 5.

It is clear that the invention has been described in relation to a preferred embodiment of a detent escapement and that the invention can be applied to any other type of detent escapement without departing from the scope of the present invention defined by the annexed claims. In particular, the invention could be applied to the detent escapements disclosed in EP Patent Application Nos. 03027910.3, 03027929.3 and 03028877.3 and to the Application made in the name of the Applicant and filed the same day, entitled "Detent escapement for timepiece", all of these Applications being incorporated herein by reference.

What is claimed is:

1. Detent escapement for a timepiece including an escape wheel fitted with teeth, a balance onto whose staff there is secured a roller including an impulse pallet-stone and in the circular periphery of which a notch is made, and a blocking member in the form of a lever hinged on a pin, said blocking member carrying means for locking the escape wheel, a control finger-piece and a follower ending in a beak arranged for cooperating with the notch of said roller, wherein said roller further includes a safety finger-piece arranged for cooperating with the teeth of the escape wheel and locking the latter when the impulse pallet-stone is accidentally unlocked from the toothing of the escape wheel.

2. Detent escapement according to claim 1, wherein safety finger-piece is placed at an angular distance $\alpha$ from the impulse pallet-stone less than or equal to 40°.

3. Detent escapement according to claim 1, wherein the safety finger-piece is placed at an angular distance $\alpha$ from the impulse pallet-stone comprised between 30 and 40° and preferably of the order of 35°.

4. Detent escapement according to claim 1, wherein the safety finger-piece is made in one piece with the roller.

5. Detent escapement according to claim 1, wherein the safety finger-piece is added to the roller.

* * * * *